United States Patent [19]

Nelson

[11] 3,970,092

[45] July 20, 1976

[54] METHOD OF ATTACHING A HAIRPIECE

[76] Inventor: Charles W. Nelson, 3534 Main St., Kansas City, Mo. 64111

[22] Filed: Jan. 14, 1975

[21] Appl. No.: 540,792

Related U.S. Application Data

[63] Continuation of Ser. No. 401,995, Oct. 1, 1973, abandoned.

[52] U.S. Cl. ..... 132/5; 132/53

[51] Int. Cl.[2] ..... A41G 3/00

[58] Field of Search ..... 132/5, 53, 54

[56] References Cited

UNITED STATES PATENTS

| | | | |
|---|---|---|---|
| 3,444,865 | 5/1969 | De Vita | 132/53 |
| 3,695,278 | 10/1972 | Rieger | 132/53 |

*Primary Examiner*—G.E. McNeill

*Attorney, Agent, or Firm*—Schmidt, Johnson, Hovey & Williams

[57] ABSTRACT

A method of attaching a hairpiece is disclosed wherein the recipient's natural hair is utilized to "lock" the hairpiece in place without the need for special attaching devices. After the hairpiece, which has a base element comprised of open-hole netting, has been properly positioned on the head of the recipient, the natural hair underlying the base element is pulled up and through the same after which a selected plurality of hair lengths are divided into pairs of groups which are then tied together to form respective knots above and in engagement with the netting, thereby attaching the hairpiece to the recipient's head. The natural hair is then blended in with the hairpiece filaments and styled along with the hairpiece as desired. This method of attaching a hairpiece not only permits attachment of the same without the use of auxiliary attaching devices but also keeps the natural hair exposed and allows the hair and scalp to be maintained in a healthy condition without removal of the hairpiece.

1 Claim, 6 Drawing Figures

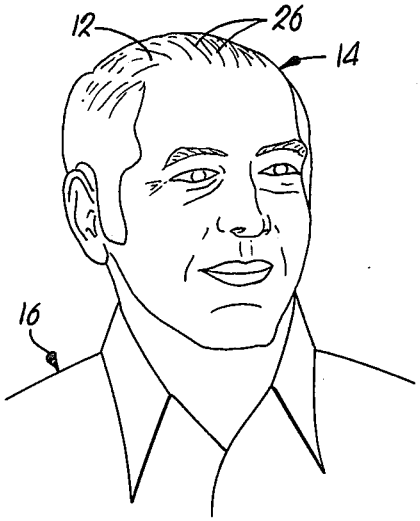
Fig.1.
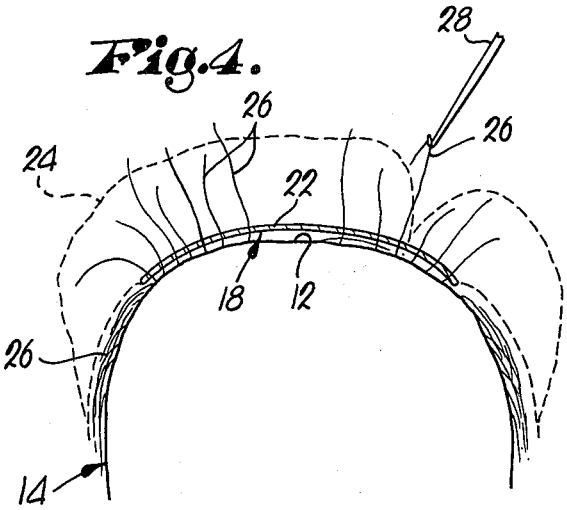
Fig.4.
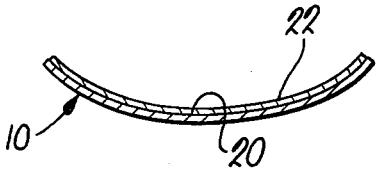
Fig.2.
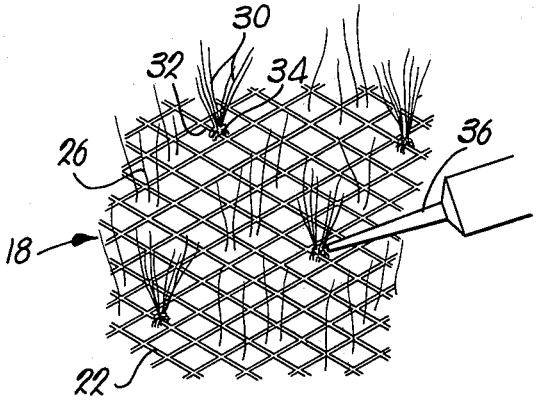
Fig.5.
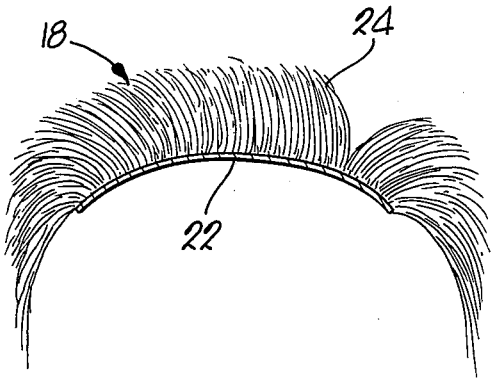
Fig.3.
Fig.6.
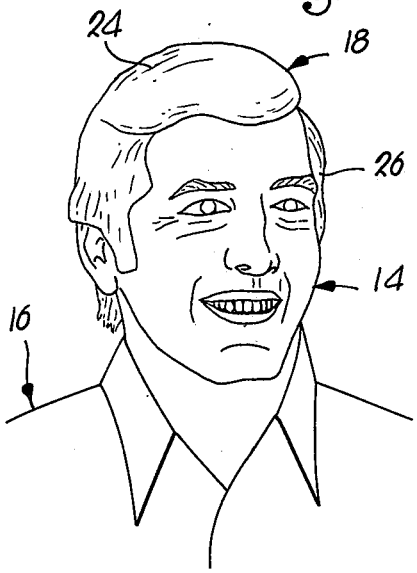

METHOD OF ATTACHING A HAIRPIECE

This application is a continuation of Ser. No. 401,995, now abandoned.

This invention relates to a method of attaching a hairpiece to the head of a recipient that has lost, for one reason or another, a porton of his natural hair and wishes to artificially replace that hair which has been lost.

Previously employed methods of attaching hairpieces have not been entirely satisfactory inasmuch as they required the use of various hairpiece attaching devices for properly securing the hairpiece to the head of the recipient. These devices generally would take the form of some mechanical contrivance that would be either uncomfortable, unreliable, difficult to secure, or possibly even unsightly and therefore less than desirable for one reason or another.

Other drawbacks of known hairpiece attaching methods included the lack of ability to properly clean and stimulate the scalp of a wearer without removal of the hairpiece and, in some instances, the wearer's natural hair would "die-out" because of the lack of proper aeration and cleaning. In other words, the matter of personal cleanliness and health, as far as the scalp was concerned, was greatly affected. Also, there could be situations in which certain activities, such as swimming or some other sport, would necessitate removal of the hairpiece.

Therefore, it is an important object of my invention to provide a method for attaching a hairpiece in which the aforementioned inconveniences, difficulties, and grooming problems are, for all practical purposes, eliminated, thus permitting the hairpiece to be substantially permanently secured.

Another very important object of the instant invention is the provision of a hairpiece attaching method which is simple and does not require the use of special securing devices whose sole purpose is limited to that of retaining the hairpiece on the head of the recipient.

Yet another important object of the invention is the provision of a hairpiece attaching method in which the scalp may be cleaned and stimulated without removal of the hairpiece or in any way detrimentally affecting its attachment to the recipient's head.

As a corollary to the foregoing object it is a further aim of the instant invention to provide a hairpiece attaching method in which the hairpiece may be substantially permanently attached to the head of the wearer and does not normally require removal therefrom.

Yet another significant object of the invention is to provide a hairpiece attaching method which permits the blending of the recipient's natural hair in with the filaments of the hairpiece in order to further supplement the same and enhance the natural appearance.

Another object of the invention is to provide a hairpiece attaching method in which the area of the head underlying the hairpiece "breathes" freely and any hot, uncomfortable feeling is avoided.

In the drawing:

FIG. 1 illustrates the head of a person as it would appear prior to the attachment of a hairpiece thereto;

FIG. 2 is a vertical, cross-sectional view of a template conforming to the recipient's head contour and a hairpiece base element molded according thereto; the template and element being shown in an inverted disposition;

FIG. 3 is a view illustrating the hairpiece as it would appear before being positioned on the recipient's head, the base element being shown in section;

FIG. 4 is a fragmentary view, shown partially in section, illustrating the pulling of the natural hair of the recipient through the base element of the hairpiece;

FIG. 5 is an enlarged, fragmentary perspective view showing the natural hair pulled through the open-hole netting defining the base element and further showing a series of knots tied in the natural hair after the same has been pulled through the base element; and FIG. 6 is a view similar to FIG. 1 with the exception that the hairpiece has now been attached and styled.

Initially, a template 10 is made which conforms in shape to an area 12 of the head 14 of a recipient 16 that is to be covered by a headpiece 18. The template 10 may be constructed in any suitable manner such as by overlying the area 12 with a pliable plastic sheet material having a shape-retaining capability or memory and backing this material with an adhesive bearing tape (not shown) to reinforce and supplement the shape-retaining characteristic of the material. A concave face 20 is thus presented having a contour corresponding to that of the area 12.

An open-hole netting 22 defining a base element of the hairpiece 18 is now molded through the use of the template 10 to present a shape also corresponding to that of the area 12 after which time filaments 24 are conventionally secured to the element 22 to complete fabrication of the hairpiece 18. So constructed, the hairpiece defines what is known as an open, ventilated hairpiece as determined by the netting making up the base element. Normally, the netting 22 is made of a suitable poly-base material with the filaments 24 likewise being made of a synthetic material as is well-known in the trade, although it is to be understood that other materials may certainly be employed.

The hairpiece 18 is placed on the head of the recipient or wearer 16 and properly positioned with the base element 22 covering the area 12, it being noted particularly that the recipient must have at least some natural hair 26 that underlies the base element 22 when the hairpiece 18 is in its desired position. In other words, the hairpiece 18 must be of a size to permit its base element 22 to be disposed adjacent some portion of the recipient's natural hair.

A hooked tool 28, such as a crochet hook, is then employed to reach down through the filaments 24 and the netting 22 to draw or pull the natural hair 26 of the wearer up and through the netting 22 as is clearly shown in FIG. 4. It is to be understood that substantially all of the natural hair 26 underlying the element 22 is so arranged and disposed.

After the natural hair 26 has been drawn up through the netting 22 a selected plurality of natural hair lengths 26 are divided into pairs of groups 30 disposed on opposite sides of a proximal stretch 32 of the netting 22 and tied together in a knot 34 above and in engagement with the stretch 32 to firmly secure the hairpiece 18 to the head 14 of the recipient 16. In this manner the natural hair is employed to "lock" the hairpiece 18 into position and the type of knot employed will depend upon the hair texture, but in any event the knot is tied by pulling, twisting, and then knotting together two adjacent groups 30. The groups 30 will vary in the number of lengths of natural hair 26 in that more lengths of hair are needed when the texture is fine, while the coarse hair requires fewer lengths per group 30. Once the knot 34 has been tied, a drop of non-allergenic adhesive, as depicted by an applicator 36 in FIG. 5 is applied to the knot 34 to prevent its becoming loose. This binding agent or adhesive may be one of several well-known substances used in the haircare profession and will not be further characterized herein.

In the event the recipient's natural hair is not sufficiently long to permit the tying of a knot, the hairpiece may alternately be held in place by simply twisting together two adjacent hair groups 30 and then applying the adhesive to the twisted hair.

The number of knots 34 required to hold a particular hairpiece 18 in place will depend upon the overall size of the area 12 to be covered and the corresponding size of the base element 22. For example, a relatively small area, such as approximately the size of a quarter, may require no more than one knot to hold the hairpiece 18 in place, whereas a hairpiece designed for full coverage of the head may require in the neighborhood of 50 knots which are selectively and randomly disposed throughout the area of the element 22 as depicted in FIG. 5.

After the hairpiece 18 has been secured as above described, it is then possible to blend the natural hair 26 in with the filaments 24 and in so doing, style the now combined natural hair 26 and filaments 24 as desired and as shown in FIG. 6. If, at some later point in time the natural growth of the hair causes the hairpiece 18 to become somewhat loosened relative to the wearer's head 14, it is but a simple matter for the wearer to have the hairpiece 18 tightened by having the knots 34 reset as by further twisting of the groups 30, or tying additional new knots 34.

Based on the foregoing description, it will become readily apparent that there is here presented a method of attaching a hairpiece to the head of the recipient in which the hairpiece is, for all practical purposes, permanently secured and need not normally be removed for cleaning purposes, normal care of the head or scalp, or because of certain activities such as swimming or other types of similar activity.

The open net construction which results in a ventilated hairpiece that permits the scalp to "breathe", does not choke off any natural hair in the area covered by the hairpiece, and permits shampooing and stimulating of the head and scalp without having any detrimental affect on the hairpiece 18. The fact that the hairpiece filaments and the natural hair are blended, enhances the natural look, helps in holding of the hairpiece in place, and makes it easier to comb and handle the hair in all conditions. The natural hair is in no way restricted or caused to "die-out" inasmuch as it is not covered over to prevent its being exposed to the air and light, but rather becomes an integral part of the hairpiece itself.

Further, not only is a healthy condition of the natural hair retained, but the need for having to provide, attach, and adjust auxiliary holding devices, which have as their sole purpose the securing of the headpiece, is eliminated along with the cumbersomeness, expense and discomfort usually associated with such devices. All types of activity may be engaged in without fear of losing the hairpiece and virtually no maintenance, other than an occasional tightening of the knots, is required that is not normally encountered in the care of one's natural hair.

Having thus described the invention, what is claimed as new and desired to be secured by Letters Patent is:

1. A method of attaching a hairpiece to the head of a recipient having at least some natural hair, said method comprising the steps of:

providing a hairpiece having a base element in the form of an open hole netting to which strands of filaments or the like have been attached to present said hairpiece;

positioning said hairpiece on the head of a recipient such that at least a portion of the recipient's natural hair underlies said base element when the hairpiece is in position;

pulling the natural hair underlying said netting through the same for protrusion therethrough to extend above said element;

selectively forming in a random pattern throughout the area of said element a series of groups of natural hair lengths comprised of a plurality of adjacent lengths thereof protruding through said netting;

dividing each group of hair lengths into two distinct groups disposed on opposite sides of an adjacent stretch of said netting;

joining together each pair of groups at a point above their respective adjacent stretch of netting;

pulling and twisting together each pair of groups such that they are in direct engagement with the proximal netting stretch to snugly dispose the same against the recipient's head beneath the point at which the pair of groups are cojoined;

locating and tying a knot in each cojoined pair of groups of hair lengths adjacent the proximal netting stretch, after the latter have been pulled and twisted together, such that the portions of hair lengths extending above each knot present free lengths and said hairpiece is firmly secured to the head of said recipient;

applying a flowable adhesive substance to each knot; and blending the free lengths of said cojoined groups of natural hair lengths and the remaining natural hair lengths protruding through said netting with the filaments of said hairpiece.

* * * * *